United States Patent [19]

Black

[11] 3,973,489

[45] Aug. 10, 1976

[54] WEB PRINTER

[76] Inventor: James A. Black, 13700 Sparta Ave., Kent City, Mich. 49330

[22] Filed: Oct. 31, 1974

[21] Appl. No.: 519,595

[52] U.S. Cl. ..... 101/115; 101/124; 101/126; 101/181

[51] Int. Cl.[2] ..... B41F 15/10; B41F 15/28

[58] Field of Search ..... 101/115, 116, 119, 120, 101/118, 123, 124, 126, 129, 178–181

[56] References Cited

UNITED STATES PATENTS

| | | | |
|---|---|---|---|
| 2,210,633 | 8/1940 | Van Der Reis | 101/115 |
| 2,764,086 | 9/1956 | Huebner | 101/179 |
| 3,650,207 | 3/1972 | Black | 101/115 |
| 3,848,528 | 11/1974 | Secdorf | 101/115 |

*Primary Examiner*—Edgar S. Burr
*Assistant Examiner*—R. E. Suter
*Attorney, Agent, or Firm*—Price, Heneveld, Huizenga & Cooper

[57] ABSTRACT

Stencilling apparatus for applying successive coatings to traveling web stock. The web stock may be advanced in successive wraparound turns to the same stencilling station. The adjacent turns are stencilled simultaneously at this station by a multipart squeegee in a multipart stencil frame, after each is placed in registry. The web tension in each turn of web stock is independently controlled by a pressure differential controller that retains a variable length loop of web under tension by a dynamic air flow pressure differential, which also causes a drying action of any coating on the web.

2 Claims, 22 Drawing Figures

WEB PRINTER

BACKGROUND OF THE INVENTION

This invention relates to coating, and more particularly to stencilling and stencil printing of web stock.

Screen stencilling of stock is a well-known process. With this process, coating materials such as inks, adhesives, and/or other functional or decorative deposits are applied through a screen stencil pattern onto stock. The stock can be any of a variety of materials such as paper, polymers, wood, laminates, or the like, for making posters, decalcomania, graphic designs, and the like.

Some such products require only one coating. However, it is often desirable or necessary to apply multiple coatings, e.g. multiple colors, to the stock by successive stencilling steps. This is normally done by conducting the stock through a series of successive printing stations and intermediate dryers arranged in tandem fashion. Such an arrangement is shown in U.S. Pat. No. 3,779,160 for example, for printing web stock. Unfortunately, such multiple station arrangements not only employ a great deal of space, but also necessitate a substantial outlay of capital.

SUMMARY OF THE INVENTION

The present invention enables a single stencilling station to coat successive deposits on web stock, the stock being advanced through the stencilling station, specially wrapped around in controlled coil fashion, and readvanced at least once more through the stencilling station, to be restencilled at a position adjacent the first stencilling operation. Therefore, repeat stencilling, even of deposit materials differing in color or other characteristics, can be achieved at the same print station, requiring a relatively small amount of space and equipment. The restencilling of the second turn of stock can be accomplished simultaneously with the stencilling of the first turn of stock adjacent to it.

Each of the coils or turns of web stock is controlled during the intermittent feed to the stencilling station, by a special air flow pressure differential applied to a loop of the web stock in a web tension control unit, also called a vacuum dancer unit. The air flow in this unit also serves a drying function to prepare the web for the next coating step, and orients the web for traverse through the stencilling station.

An important object, therefore, of this invention is to provide stencilling apparatus wherein the web stock can be returned at least once to the original stencilling station in wraparound fashion for another stencilling deposit in registry with the first. Another object is to provide such a wraparound stencilling apparatus having dynamic control over the web tension in turns of the web, without physical engagement with the freshly coated surface, by using special gaseous flow which effects a pressure differential web tension control and also serves a drying function.

The repeat stencilling station has a multiple-part squeegee cooperative with a multiple-part stencil frame to simultaneoulsy apply successive coatings on adjacent turns of the web stock.

Another object of this invention is to provide stencilling apparatus capable of multiple stencilling steps at the same station on successive turns of the same web stock, especially narrow web stock, but also capable of alternately applying a single stencil coat at that station on web stock that is not coiled back to the same station, such as on one wide web or on a multiple of narrower webs. To do the latter, the narrower webs are stencilled simultaneously in the one print station by the multipart squeegee and stencil frame.

Another object is to provide a wraparound stencilling press having a multipart squeegee arrangement wherein each is submerged beneath the coating fluid to be stencilled. This enables fast drying stencilling fluid to be employed, such that each deposit or coat can be quickly dried in a pressure differential control slack chamber i.e. vacuum dancer, while the web is in a coil to be wrapped around to the station for another stencilling function or the like. Each wrapped around coil is registered prior to stencilling, preferably by slit registry that uses specially preformed transverse slits along the length of the web stock.

These and several other objects, features, and advantages of the invention will be apparent from the following detailed description and the illustrative embodiment depicted in the drawings.

DESCRIPTION OF THE PREFERRED EMBODIMENTS

Figure 1:
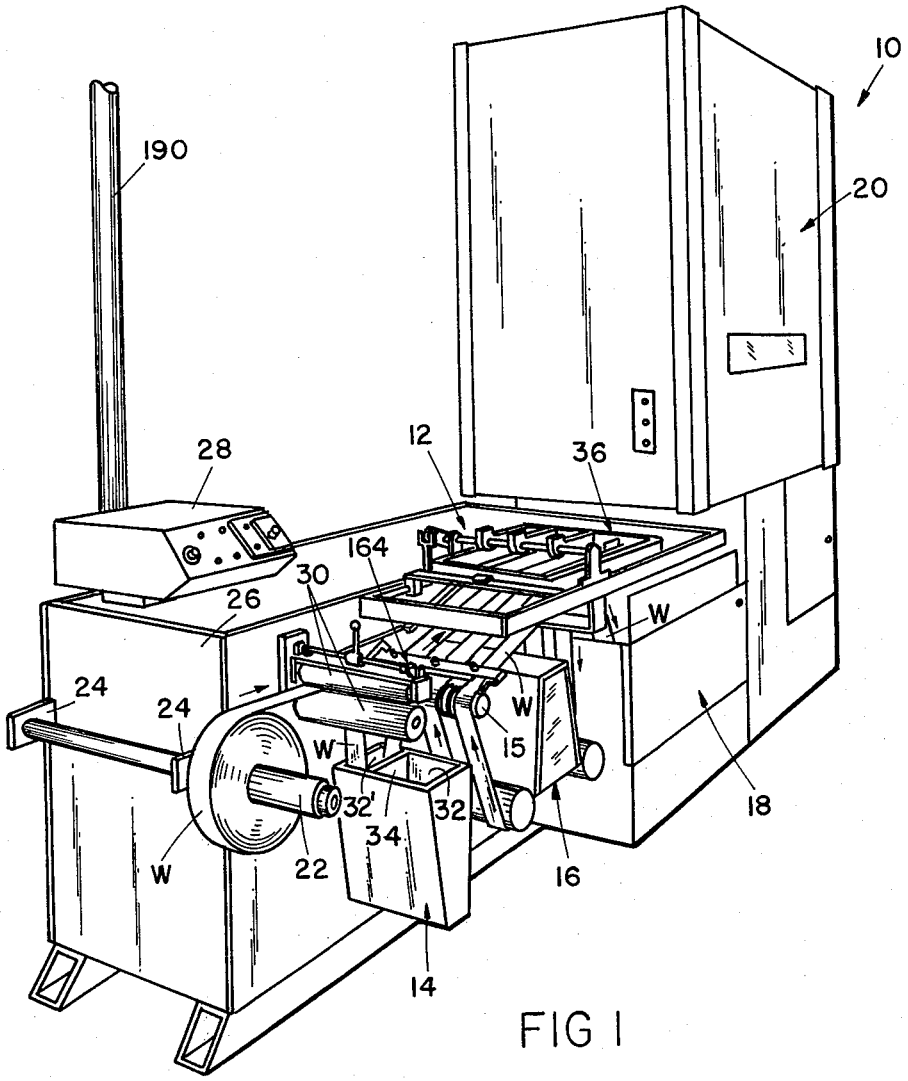
FIG. 1 is a perspective view of the novel apparatus forming a combination stencilling station and dryer operative on the wraparound principle.

Referring now specifically to the drawings, the assembly 10 depicted in FIG. 1 includes a stencilling assembly 12 employed in wraparound fashion and shown with an upright pressure differential control, i.e. vacuum dancer subassembly 14, and an inverted vacuum dancer subassembly 16. Downstream of stencilling station 12 is another upright vacuum dancer subassembly 18 and an optionally used tower dryer subassembly 20. The total assembly in FIG. 1 is thus shown operative on a wraparound web W of relatively narrow width.

Figure 3:
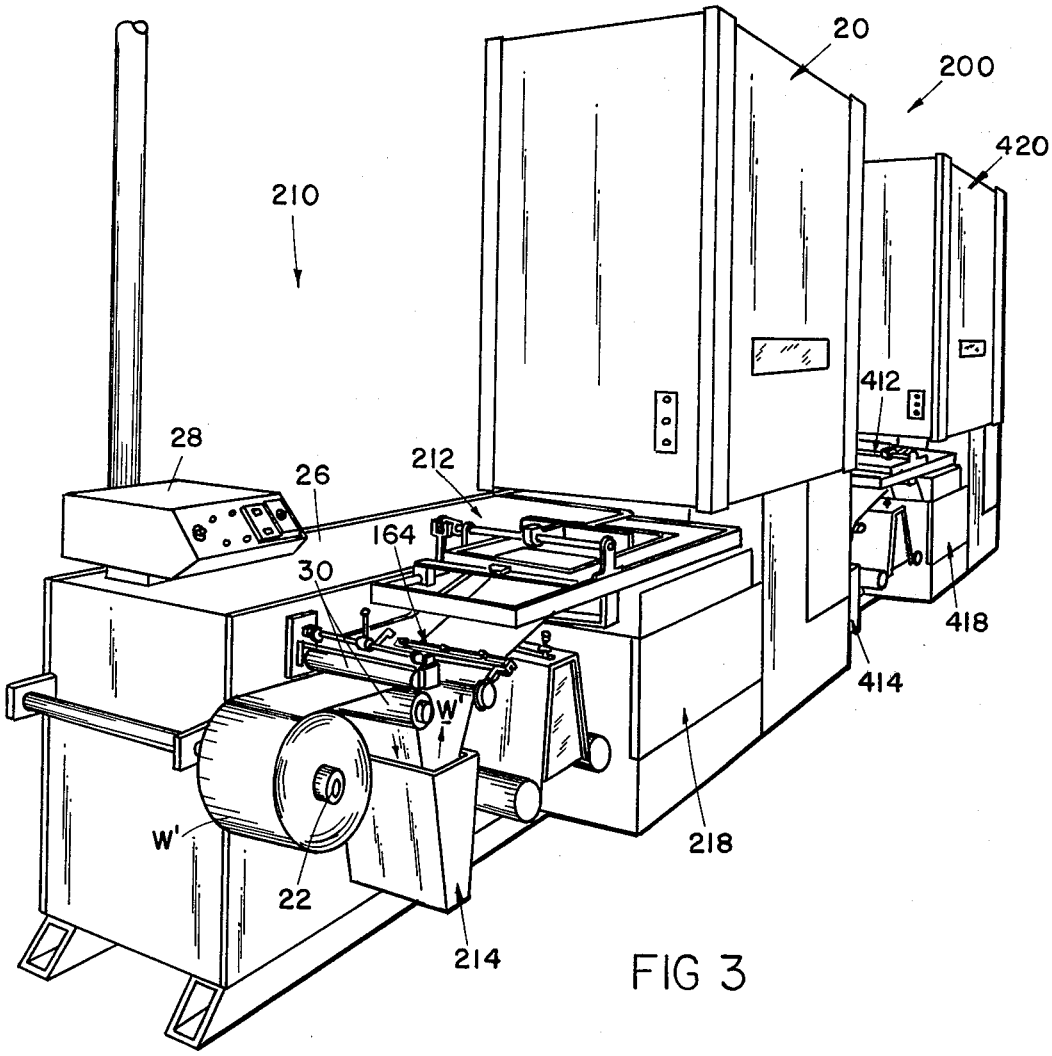
FIG. 3 is a perspective view of the apparatus in FIG. 1 operative on a nonwraparound basis, and coupled with a second stencilling station and second dryer.
Figure 6:
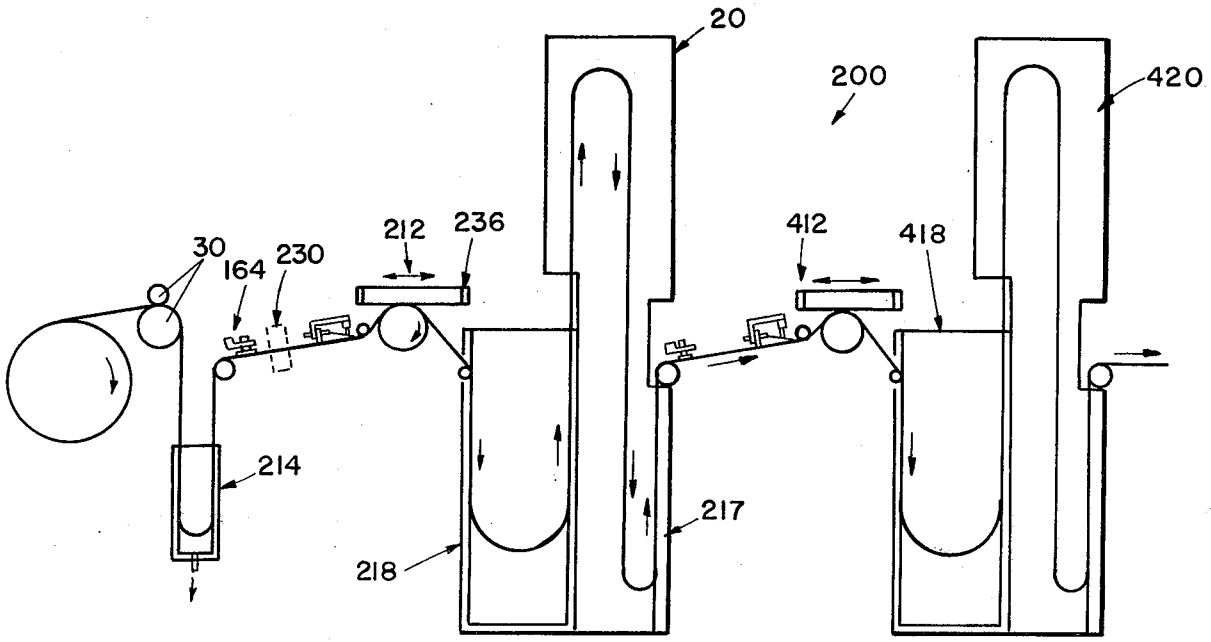
FIG. 6 is a side elevational schematic view of the apparatus in FIG. 3 operative on a nonwraparound basis, and with the plural stencilling stations and plural dryers.

In FIG. 3, the complete assembly 100 is shown with stencilling assembly 212 slightly modified to be operative on a relatively wide web W'. The web is controlled by a first upright vacuum controller 214 prior to passage through the stencilling station, and by another upright vacuum controller 218 subsequent to such passage. The apparatus here depicted is shown in combination with a tower dryer 20 like that in FIG. 1. In this embodiment, a second stencilling station subassembly 412 is set forth, as well as another upright vacuum controller subassembly 414, upstream of station 412 and another vacuum controller subassembly 418 downstream of station 412, with a second tower dryer 420 downstream of that. The number of stencilling stations can be varied to suit the nature of the web stock, the coating substance being applied, whether the wraparound principle is or is not employed, and other variables. Also, the number of tower dryers employed can be varied, e.g. none, one, two, or more. For example, in FIG. 4, the apparatus depicted is employed in a wraparound fashion and without a tower dryer. In FIG. 5, the apparatus is shown employed in nonwraparound fashion, without a tower dryer. In FIG. 3 and FIG. 6, the apparatus is depicted in nonwraparound fashion, with two stencilling stations and two respective tower dryers, in addition to the upright web control units which also perform a drying function as well as tension control in a manner to be described hereinafter.

Figure 2:
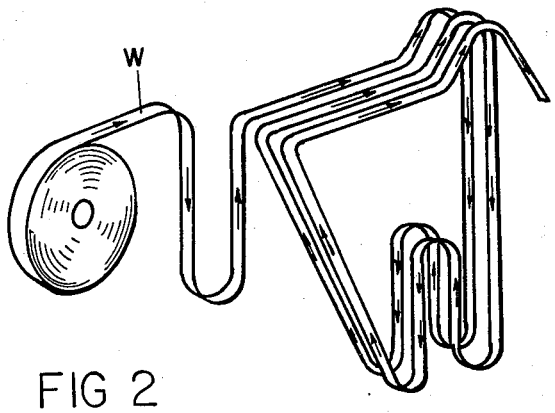
FIG. 2 is a schematic perspective view of the web stock pattern in FIG. 1.

Referring now specifically to the apparatus depicted in FIGS. 1 and 2, a reel of web stock W is mounted on a suitable stock support spindle 22 supported on spaced bearing plates 24 on housing 26. Mounted on this housing is a suitable control console 28. A pair of driven feed rolls 30 pull web W off the reel. Operation of these feed rolls can be controlled in relation to the amount of web that is in the loop extending down into and up out of pressure differential control or vacuum dancer unit 14.

This controlling unit constitutes a chamber having a web entry and exit opening in one face, here the top, so that the web enters and leaves the chamber through the open top. Since a narrow web is depicted in FIG. 1, the chamber 32 is shown with a removable divider panel 34 to cause the width of the chamber portion 32' through which the web passes to be just slightly greater than the web. A pressure differential is caused to occur dynamically across the web i.e. between the inner and outer faces of the U-shaped loop of web in this chamber. In the unit as depicted, this differential is formed by drawing a partial vacuum on the lower face of the web loop therein to form the pressure differential between the atmospheric pressure on the upper side of the web and this partial vacuum on the lower side. The clearance between the edges of the web loop and the adjacent chamber walls results in dynamic air flow into the chamber through the open top, across the surface of the web loop, and out through the bottom of the chamber. This pressure differential maintains the web in a looped condition in this chamber to hold the web under a controlled tension while not interfering with advancement of the web therethrough. This pressure differential maintains the controlled tension even though the length of the loop in this chamber varies. Web W, after passage through unit 14, is advanced to stencilling appartus 12.

Figure 16:
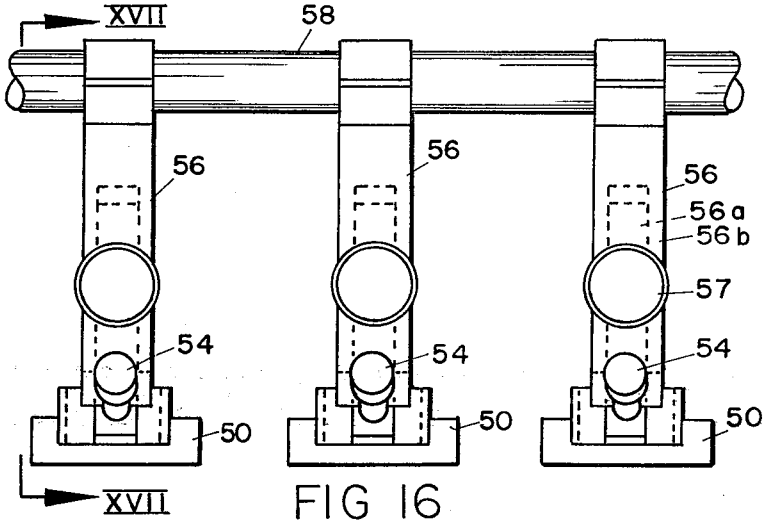
FIG. 16 is a top plan view of the multipart squeegee assembly in FIG. 15.
Figure 15:
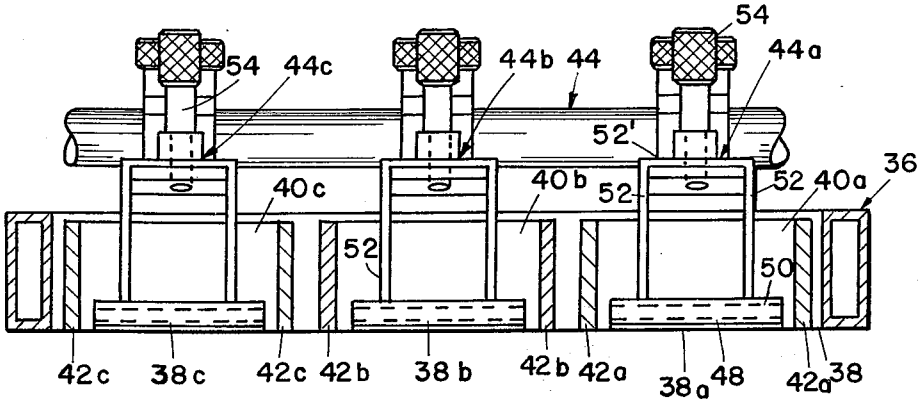
FIG. 15 is a front elevational view of a multipart squeegee and stencil screen frame assembly usable with the apparatus when one web is advanced in wrapped fashion, or a plurality of adjacent webs are advanced simultaneously.

In this wraparound version of the press in FIGS. 1 and 2, stencilling apparatus 12 is capable of simultaneously stencilling a multiple, here three, of web portions simultaneously. The basic stencilling occurs by reason of a stencilling fluid being forced down through pattern areas of a stencil screen by a multiple part squeegee device. Since the illustrative embodiment depicts three web portions spaced in side-by-side fashion at the stencilling station, there will be three laterally spaced, like squeegee components cooperative with three separated stencil screen zones in the stencil screen frame. The stencil screen frame 36 (FIGS. 1 and 15) includes a typical peripheral member formed as of tubular stock forming upstanding peripheral side walls and having a stencil screen 38 stretched across its lower peripheral planar portion to be secured to the frame. This securement may be for example like that shown in U.S. Pat. No. 3,273,497. When a multiple part squeegee of the type illustrated in FIGS. 15 and 16 is so employed, the space defined within the peripheral frame of the stencil screen frame and above the stencil screen 38 is purposely divided off into elongated reservoirs **40*a*, 40*b* and 40*c*, as by respective pairs of elongated plates 42*3* and 42*c* attached to the frame at their ends. The stencil screen 38 therefore has three distinct zones 38*a*, 38*b* and 38*c*, each with its own pattern. Extending downwardly into the three zones 40*a*, 40*b*, and 40*c* are the respective three squeegee subassemblies 44*a*, 44*b* and 44*c* comprising squeegee assembly 44**. The structure of the squeegee apparatus can vary considerably.

Figure 17:
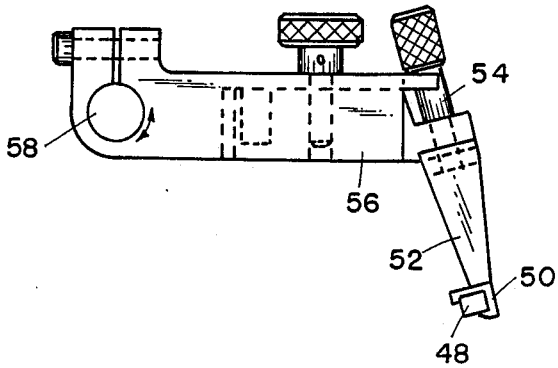
FIG. 17 is a side elevational view taken on plane XVII—XVII of FIG. 16.

When the stencilling equipment is being used for printing multiple colors on the web stock in wraparound fashion, it is preferable to use a fast drying or solidifying fluid in this apparatus to be assured that the coating on each turn of the web stock will be dry by the time the web is wrapped around and ready for the next stencil coat. Such fast drying fluids should be kept to a substantial depth in the frame if possible to avoid drying out on the stencil screen as might occur if a conventional squeegee mechanism were employed. Deep pools of such fluid, e.g. ink, are not very practical with a conventional squeegee apparatus because the squeegee tends to push most of the fluid ahead of it and splash it over the end of the stencil frame while a small portion is being forced down through the pattern area of the screen onto the underlying stock. Therefore, a special submerged squeegee is preferably employed for each of the squeegee subassemblies in such an arrangement. This submerged squeegee has a submerged squeegee blade 48 (FIG. 17) in a holder 50 which is mounted on the lower ends of the pair of spaced legs 52 of a U-shaped support so that the fluid can move over the blade and between these legs while stencilling. The upper cross leg 52' (FIG. 15) of this support is secured as by a threaded fastener 54 to the end of a cantilever arm 56. Each arm 56 is optionably, telescopically adjustable in length by reason of an inner slidable element 56*a* (FIG. 16) in bifurcated outer element 56*b* and secured together by fastener 57. The plurality of cantilever arms for the respective squeegee subassemblies are all mounted at their oppostie ends on a transverse pivot rod 58 which can be rotated a controlled amount to raise and lower the squeegee blades into and out of engagement with the stencil screen 38. The squeegee blades 48 thus can be immersed in a substantial depth of te stencilling fluid such that, during the stencilling stroke, while a small amount of the fluid is forced by the lower edge of the squeegee blades through the stencil screen onto the underlying stock, the excess merely flows over the submersed squeegee blade without splashing. On the return strode, the squeegee is lifted slightly out of engagement with the stencil screen and returned to its initial starting position. The particular embodiment of submersible squeegee can be modified, as for example as set forth in copending application entitled STENCIL SCREEN COATING APPARATUS, Ser. No. 519,539, filed Oct. 31, 1974, by James A. Black.

Figure 11:
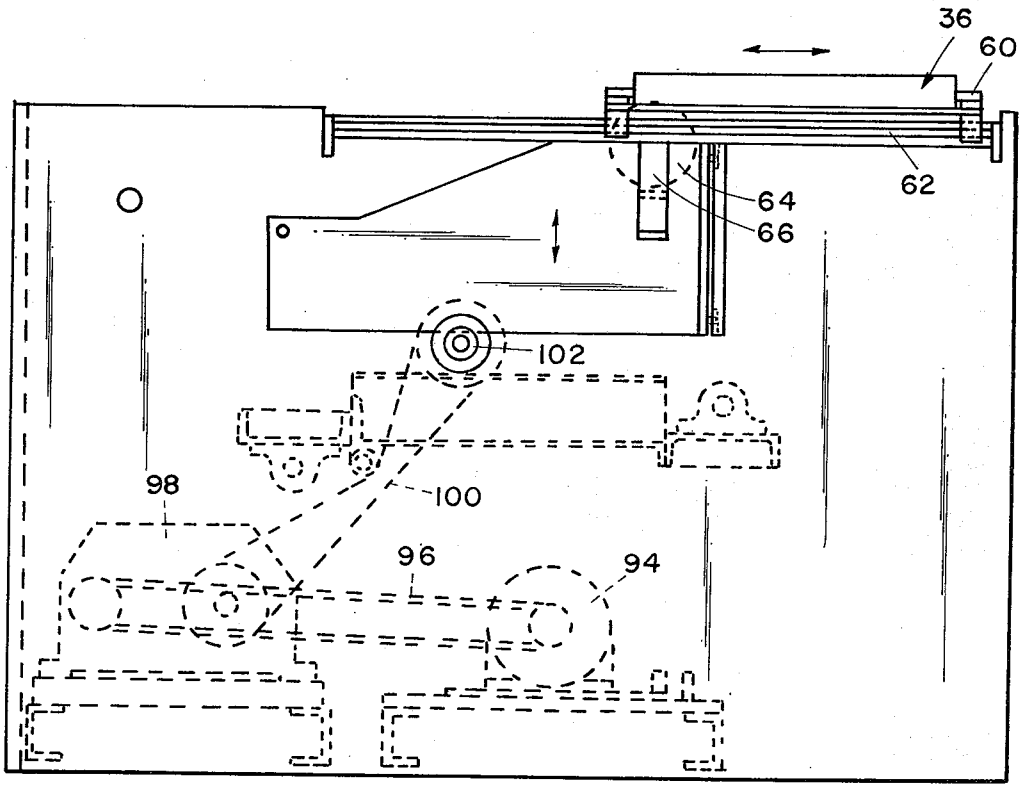
FIG. 11 is a side elevational view of the stencilling station drive apparatus in FIG. 10.
Figure 10:
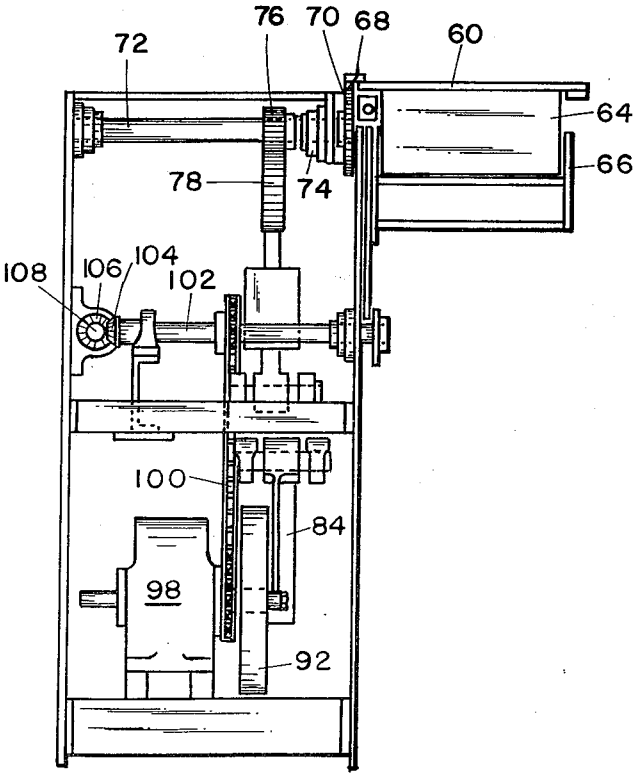
FIG. 10 is an elevational view of the drive apparatus for the stencilling station.
Figure 12:
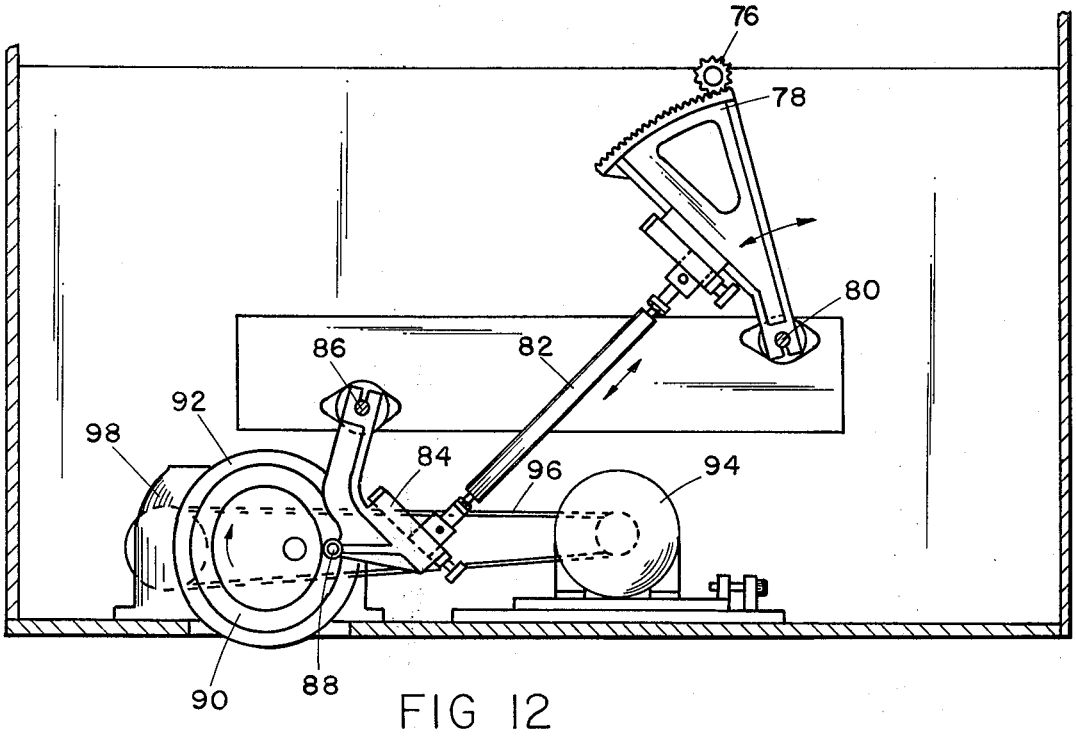
FIG. 12 is a side elevational view of a portion of the drive apparatus in FIGS. 10 and 11.

This stencilling occurs during reciprocating motion between the stencil frame and squeegee. In the depicted embodiment, (FIGS. 10–12), the stencil screen frame 36 is mounted on reciprocable carriage 60 supported on guides 62 and movable back and forth beneath the squeegee and over the crown of conventional impression cylinder 64 rotatably mounted on supports 66. The stock advancement causes the cylinder to advance at the same rate as the stencil screen frame. Typically, a gear rack 68 along one underside side edge of carriage 60 engages with a drive spur gear 70 therebeneath, this spur gear being mounted on a shaft 72. Cylinder 64 may be rotationally driven by this mechanism, or alternatively, may be of the idling type to be rotated simply by the frictional engagement of the squeegee, the advancing stencil screen, and the stock against the cylinder. If the friction is not adequate, high friction material such as sandpaper is employed between the cylinder and screen to prevent slippage therebetween. Also mounted on shaft 72 is another spur gear 76 driven by gear sector 78 pivoted on shaft 80 and driven by reciprocating crank 82. This adjustable crank is mounted between gear sector 78 and a pivot lever 84 on pivot 86 and includes cam follower roller 88 in cam track 90 of rotating cam wheel 92. Cam wheel 92 is driven by a motor 94 through a belt 96 and gear box 98. The output of gear box 98 also drives a chain 100 to power a shaft 102 and bevel gear 104 thereon engaging a bevel gear 106 on an elongated drive shaft 108 that extends to the next printing station if such is employed. Thus the first stencilling station constitutes a master unit which can drive any subsequent stations as slave units in synchronism therewith in conventional fashion.

Registration of the web in this invention is shown obtained by a slit registry system. The slit registry apparatus subassembly 112 is depicted as located upstream of the stencilling station. However, as set forth in copending application Ser. No. 519,591, filed Oct. 30, 1974, and entitled WEB SLIT REGISTRY by James A. Black and Harry Russell Farwell, this registry apparatus can be downstream of the stencilling station. Whether it is one position or the other depends on the type of operation, type of stock, where on the stock the registry slits are formed, and other factors. Such alternative embodiments of registry apparatus set forth in said last noted application are incorporated herein by reference. Further, although the particular registry apparatus is shown herein to constitute one type of mechanical or physical apparatus, it can vary considerably as set forth in said copending application just identified. In addition, in this particular embodiment of the registration apparatus set forth herein, the slit forming means is shown to be mounted adjacent two registry elements, the slit forming means being operative on the first pass of te wraparound web to both cut the slit and also thereby provide the registry locus, and registry fingers being operative on the second and third passes of the wraparound web. However, the slit forming apparatus can be mounted separately and upstream from the registration means, and all three passes being registered by interengagement of a registry surface with the edge of the stock at the slit.

Figure 7:
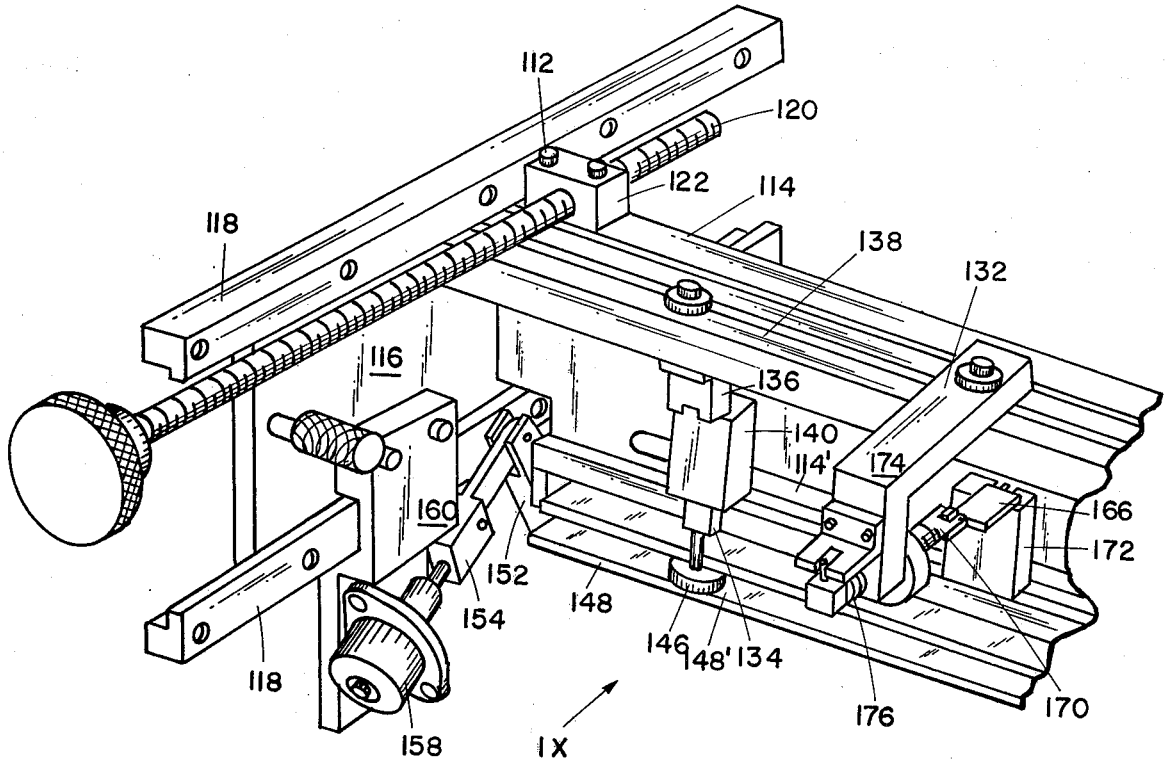
FIG. 7 is a fragmentary, enlarged, perspective view of the registry slit forming apparatus and slit engaging apparatus.

Subassembly 112 (FIG. 7) includes a transverse cantilever support 114 mounted on a slide plate 116 supported within a pair of slide track elements 118 on the frame of the stencil machine. Elements 114 and 116 can be longitudinally adjusted relative thereto by rotationally loosening threaded rod 120 threadably engaged with block 122 on element 114.

Figure 9:
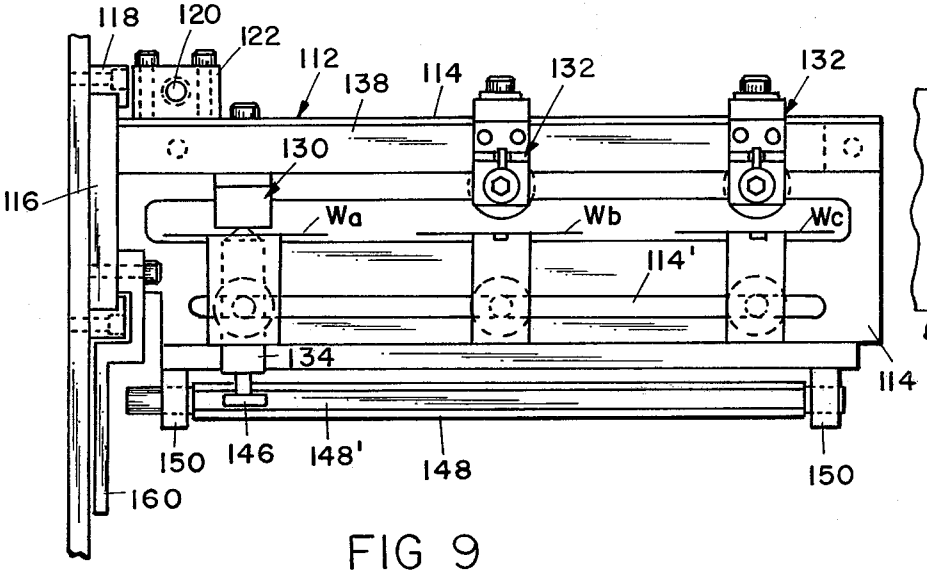
FIG. 9 is an elevational view of the apparatus in FIG. 7 taken in the direction of the arrow IX in FIG. 7.

Cooperative with the first pass of the web, i.e. W*a* (FIG. 9) is slit forming subassembly 130 (FIG. 9). Cooperative with the second pass of the web W*b* and the third pass of the web W*c* are like respective registry subassemblies 132.

Figure 8:
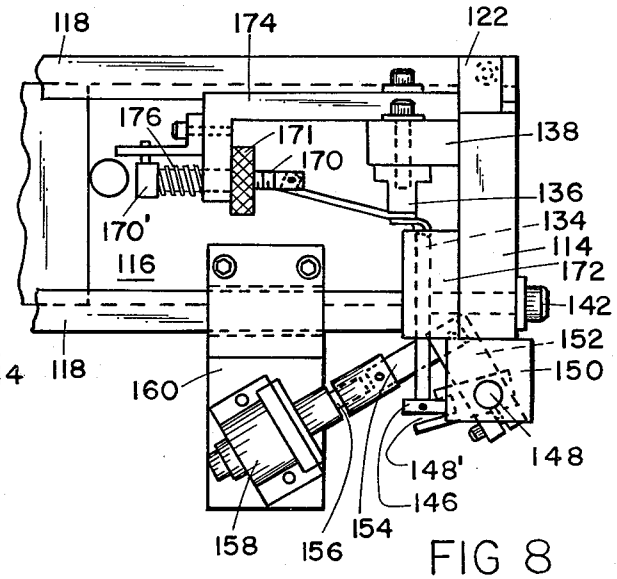
FIG. 8 is a fragmentary side elevational view of the apparatus in FIG. 7.

Slit forming subassembly 130 includes a vertically upwardly reciprocable lower shearing blade 134 (FIG. 8) cooperable with an upper anvil-type shearing element 136 thereabove, to form a transverse slit in the web stock between these two elements. Anvil 136 is mounted by block 138 to support 114. Lower blade 134 is mounted in a guide block 140 secured by stud 142 to support 114 through an elongated slot 114', allowing adjustment along support 114, i.e. transversely across the width of the web. Attached to the lower end of blade 134 is a collar 146 that extends into an elongated transverse slot 148' between flanges of a pivotal bar 148. This bar has its opposite ends mounted in bearing plates 150 depending from support 114. Attached to one end of bar 148 is a link 152 pivotally conected to another link 154 (FIG. 8) in turn connected to the extended rod 156 of a reciprocable actuator 158 such as a fluid cylinder or solenoid. This actuator is mounted on a bracket 160 attached to and suspended from slide plate 116. Thus, actuation of this element 158 elevates cutting blade 134 into cooperative cutting relation with anvil 136, forming a slit transversely of the web stock therebetween. This slit forming apparatus is actuated when the web is held between a web pull-back device 164 (FIG. 1) upstream of the slitter, and a web tension control unit downstream of the slitter. The web pull-back device may constitute a simple vacuum bar extending across the web stock and shiftable a small amount in the reverse direction of the web advancement, such that the slight restraining force applied to the web at the vacuum orifices will, when the bar is shifted rearwardly, pull the web stock until the registry surfaces on the fingers of the registry subassemblies 132 positively engage the stock and arrest further movement thereof in a manner to be described in detail hereinafter.

Figure 1B:
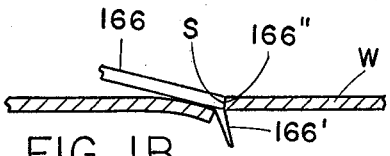
FIG. 1*b* is a sectional view of the subject matter of FIG. 1*a*.
Figure 1A:
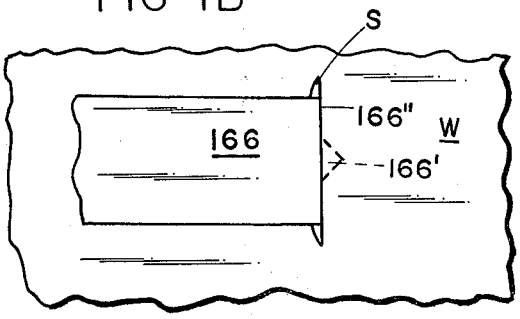
FIG. 1*a* is an enlarged fragmentary plan view of a portion of web stock being slit registered for stencilling in the apparatus of FIG. 1.

As noted previously, actuation of the slit forming subassembly forms a transverse slit S in the web W (FIG. 1*a*). As the web is viewed in FIG. 1*a*, it would normally advance intermittently to the right. At the end of each intermittent feed stroke, the vacuum pull-back device 164 reverses the direction of the web a small amount to pull all three passes of the web rearwardly a small amount for registration purposes. As the web moves rearwardly, i.e. to the left as depicted in FIG. 1*a*, the registration plates 166 of the registration subassemblies 132 engage with the stock edges at the slits to arrest further reverse motion of the web. More specifically, the pointed central finger 166' which projects downwardly toward the stock from the free end of each plate 166 moves through the slit S, causing the registration surface 166'' on the straddling shoulders on the end of plate 166 to engage the slit edge of the web. When this occurs, the three passes of the web are under tension between the vacuum pull-back device, past the slit former and double register device over the print cylinder to the upright control subassembly 18. Thus, the slit former can be actuated to form the new slit in the first pass of the web, and the stencilling apparatus 12 can then be actuated to simultaneously print portions of all three passes of the web stock adjacent the impression cylinder. The registration finger plate 166 is pivotally mounted on one end to a transverse stud 170 (FIGS. 7 and 8) with the opposite end resting on the upper slotted end of a support block 172. Stud 170 is slidably supported in an L-shaped bracket 174, and has a compression coil biasing spring 176 around the back end thereof between bracket 174 and an enlarged head 170' so that the longitudinal position of the registration surface 166'' can be adjusted, i.e. in the direction of web movement, by turning knurled knob 171.

Figure 4:
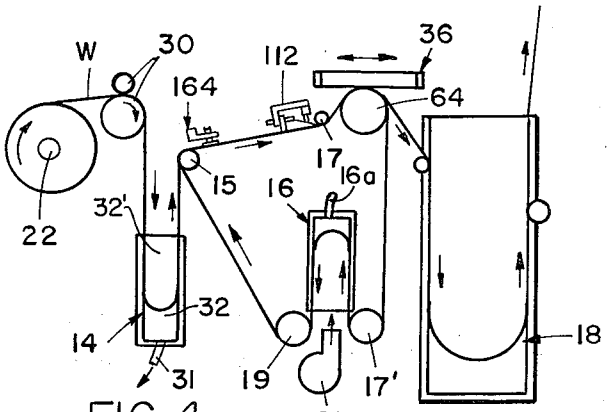
FIG. 4 is a side elevational schematic view of the wraparound apparatus in FIG. 1 but not depicting the tower dryer shown therein.
Figure 5:
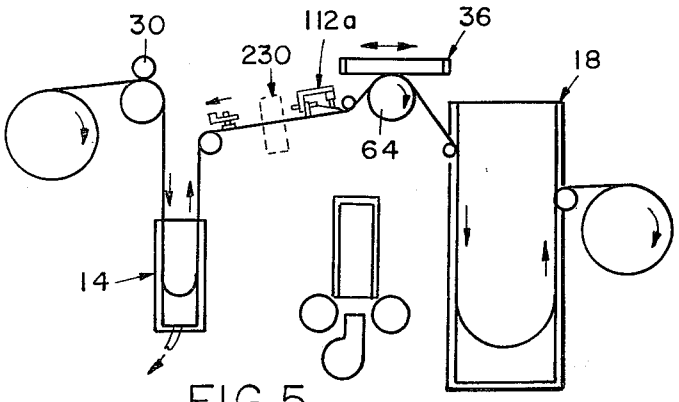
FIG. 5 is a side elevational schematic view of the apparatus in FIG. 1 operative in a nonwraparound fashion, as on a plurality of adjacent narrow webs, but not depicting the tower dryer.
Figure 14:
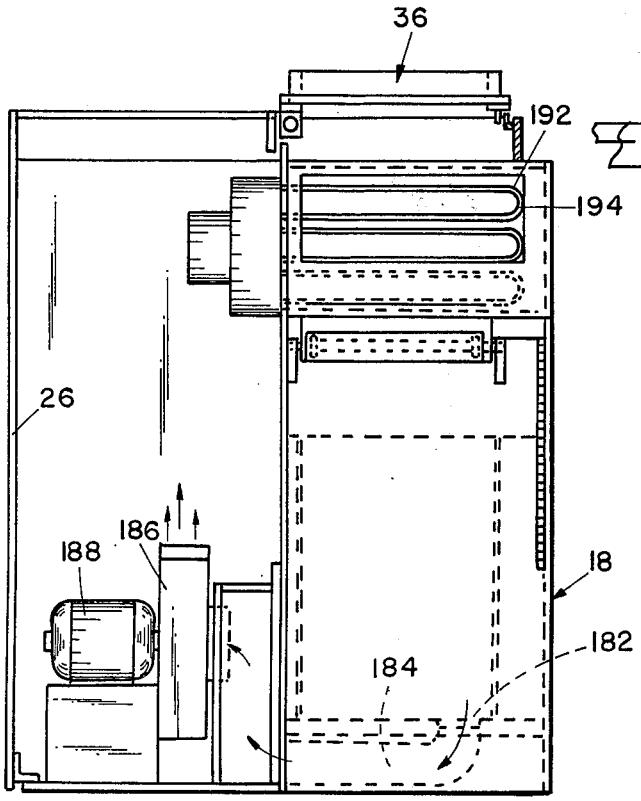
FIG. 14 is an end elevational view of the apparatus in FIG. 13.
Figure 13:
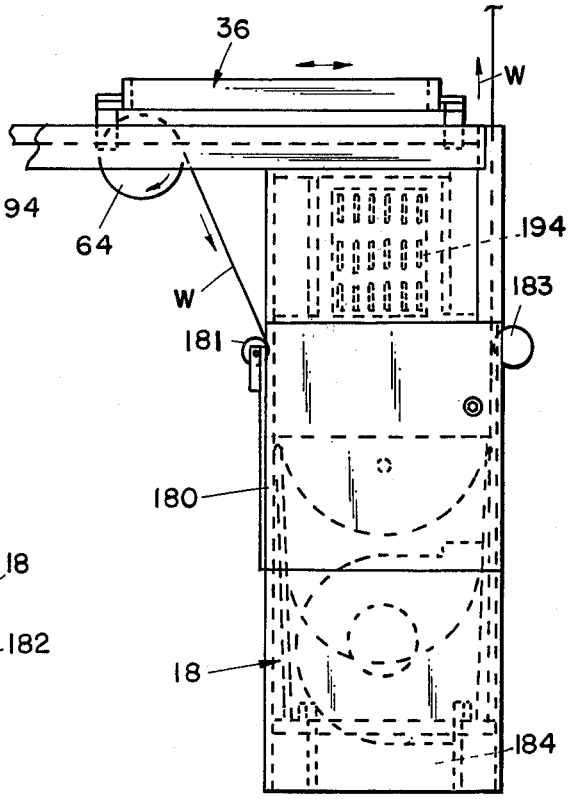
FIG. 13 is a side elevational view of the pressure differential web control unit of the apparatus.

Downstream of the stencilling station is the pressure differential web tension control and drying unit 18 (FIGS. 1, 4). This unit 18 may be used in combination with tower dryer 20 or without the tower dryer (FIGS. 1, 6). That is, for some type of stencilling operations, the drying action of this tension control apparatus may be adequate without the added dryer. This subassembly 18 includes a housing 180 forming a chamber with opening means 192 in the top face for entry and exit of web W, and suction outlet means 182 at the bottom communicant through a conduit 184 to a suction pump or fan 186 driven by motor 188. Fan 186 is enclosed in housing 26 (FIG. 1 and FIG. 14) communicant with an exhaust stack 190 for discharge of solvent vapors or the like from the coating material dried on the web. The opening 192 allows air to be constantly dynamically drawn into the chamber, through the clearance around the edges of the U-shaped web loop, and out the suction outlets, to impart a drying action and also apply a pressure differential across the loop of web stock in the chamber. The web loop is shown in two different positions in FIG. 13 to illustrate how its length and hence the position of its bight portion can vary. Heater coils 194 may be installed above the chamber to allow the air being pulled through opening 192 to be heated for accelerated drying or curing of the coating material on the stock. As will be noted, the upper stencil coated surface of the web is not physically engaged during its traverse through this control device. The only engagement is by the underside web surface against an input guide roll 181, against the inside walls of the chamber, and an optional output guide roll 183. The walls of the chamber are preferably coated with a lubricious polymer such as "Teflon" to minimize frictional drag.

The tower dryer 20 basically includes web guide means such as a recirculating belt or the like around upper and lower pulleys to cause the web to rise to the top and then down the opposite side while held to the belt as by a pressure differential. The specific form of the apparatus can be like that set forth in detail in copending U.S. patent application Ser. No. 515,639, filed Oct. 17, 1974 entitled VERTICAL DRYER, by James A. Black and Harry Russell Farwell, now abandoned and incorporated by reference herein.

FIG. 4 depicts the basic operation of the apparatus in FIG. 1, without the tower dryer 20 as part of the assembly. To perform the repeat stencilling operations in accurate registry on web stock wrapped around repeatedly to make a multiple pass through the same stencilling station, the following steps occur. The web stock W is pulled from a reel on spindle 22 by feed rolls 30 and fed down into and back out of the open top of a portion 32' (FIG. 4) of chamber 32 of pressure differential control unit 14. A dynamic pressure differential is applied across the face of the web as it passes in a loop through this unit 14 as by applying a dynamic suction to the bottom of the chamber through outlet 31, causing pressure differential between this partial vacuum and the atmospheric pressure on the top of the web, and also removing excess moisture from the stock. The web then travels around guide roll 15 and into engagement with a vacuum pull-back subassembly 164, past the slitting apparatus (FIG. 7) and slit registry apparatus 112, around another guide roll 17 (FIG. 4) and up over impression cylinder 64 beneath the stencil screen frame 36 and the squeegee assembly therein. The web then travels down around the curved guide member 17' adjacent one edge of the open bottom pressure differential control unit 16, up into this chamber in loop form, back down around guide member 19, and back to guide roll 15. The pressure differential in the chamber of unit 16 may be achieved by having a blower 21 adjacent the bottom open end to blast hot air or the like into the chamber. A vacuum source may or may not be coupled with the exhaust outlet **16*a* on the closed top end of this chamber, opposite the open end, to form the desired controlled pressure differential dynamically across the web while also performing an important drying function. The wraparound web then passes back through the stencilling station adjacent to and spaced from the first turn of web, at registry unit 132 (FIG. 7), and back around again through this same pattern to the third stencilling position alongside the second turn of web in the same stencilling station. The arrangement of the three passes or turns of web relative to each other is depicted in FIG. 2. The inverted web stock control unit 16** not only controls the tension in the second and third turns of the web, and performs the drying function mentioned, but also, by being positioned at an adjustable slight acute angle relative to the longitudinal direction of the apparatus, orients the web in a slight skew arrangement to cause each web pass to advance alongside the previous pass and prevent it from overlapping the previous one through the stencilling station.

When these pressure differential control units 14 and 16 are employed for narrow web widths, preferably dividers such as at 34 in unit 14 (FIG. 1) are inserted to keep the web passes separated therein.

When the three passes of web stock are so arranged, for example if the chosen pattern is to be printed in three successive colors in the three successive passes through the same stencilling station, the three portions 40*a*, 40*b* and 40*c* of the stencil screen frame subassembly 36 (FIG. 15) are filled at least partially with the three different color inks. Before the stencil screen frame is lowered in conventional fashion to the web and imprint cylinder, the exact position of the three passes of web are pre-set and controlled with the apparatus in FIG. 7. That is, by pulling the three passes of web backwards a slight amount with the vacuum pull-back unit 164 or any equivalent thereof, the three webs are pulled back simultaneously until the registration units 166 engage the edges of the stock at the slits in the second and third passes of the web stock. At this point, the blade 134 of the slit former is raised by actuation of unit 158 to form a slit in the first pass and hold this first pass in registry for stencilling. Then, the stencil screen frame is lowered along with the squeegee units, to be in printing relationship relative to the three passes of the web stock, the stencil carriage is advanced along with simultaneous forward rotation of impression cylinder 64, causing the squeegee elements 48 to print the three colors simultaneously on the different three passes of the web stock. The squeegee units and stencil frame are then raised and returned to the initial starting position in preparation for the next print stroke. On successive advancement of the web, all three passes are advanced in the pattern set forth in FIG. 4, the first and second pass being advanced in successive increments down around guide 17 into tension control-dryer-orientor 16 and back around through the print station again, while the third pass travels through the pressure differential controller-dryer unit 18, and, if necessary, to tower dryer 20.

The apparatus previously described can be used in a slightly modified form on other than wraparound arrangements. For example, when printing on wider web stock as set forth in FIGS. 3 and 6 or on a plurality of narrow webs fed directly through the stencilling station. This unit is depicted without the tower dryer in FIG. 5.

Figure 20:
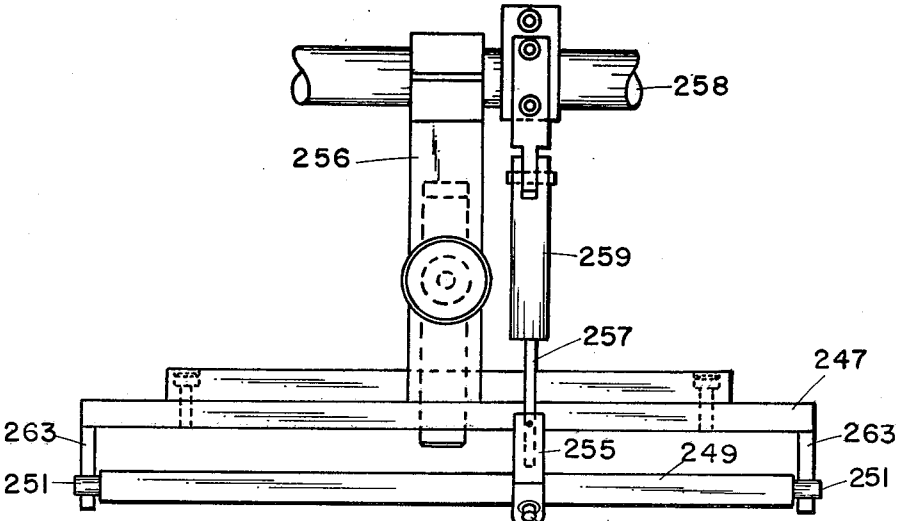
FIG. 20 is a top plan view of the apparatus in FIGS. 18 and 19.
Figure 19:
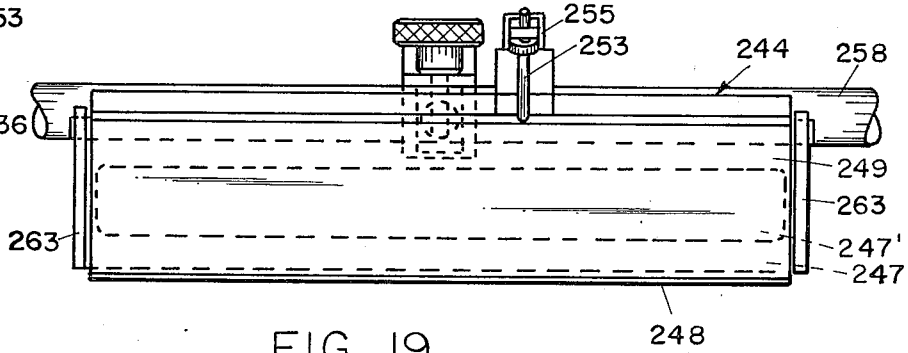
FIG. 19 is a view of the apparatus in FIG. 18 taken on plane XIX—XIX.
Figure 18:
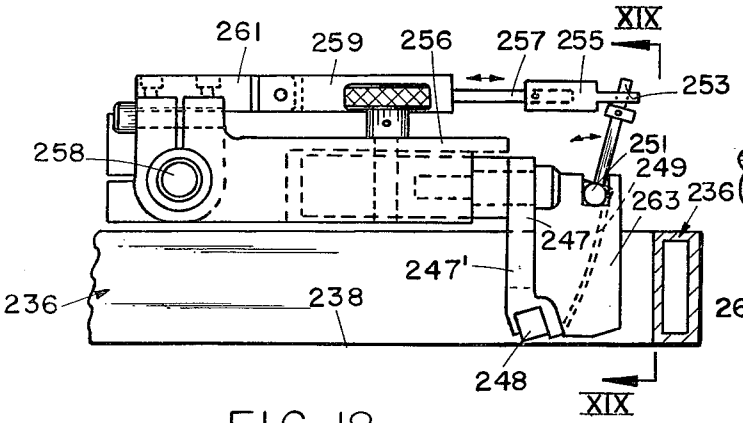
FIG. 18 is a side elevational view of a full width squeegee assembly employed in the stencilling station on a wider web not in wraparound fashion.

In the modified apparatus 210 set forth in FIG. 3, the same control console 28 is employed on housing 26, and the same spindle 22 is employed to support the wider roll of web stock W′. The web stock W′ is removed from this reel by the same feed rolls 30, and passes down through pressure differential control unit 214 modified by the removal of divider elements 34 so as to accommodate the wider web W′. The web passes down into the control chamber and back out the open top, past the vacuum pull-back unit 164. The web then passes into the modified stencilling apparatus 212 which includes a stencil screen frame 236 like that at 36 but with the dividing plates 42*a*, 42*b* and 42*c* removed so that one continuous chamber is formed thereacross. Likewise, a full width squeegee apparatus is employed, of the type set forth for example in FIGS. 18, 19 and 20 at 244 or in U.S. Pat. No. 3,252,411 or a submersible type set forth in copending application Ser. No. 519,539, filed Oct. 31, 1974, entitled STENCIL SCREEN COATING APPARATUS, by James A. Black.

The squeegee blade 248 is retained by mount 247 on the end of a cantilever arm 256 supported on a pivot bar 258 so that blade 248 can be raised or lowered in relation to stencil screen 238 mounted along the planar undersurface of frame 236. A flow coater such as shiftable flow coater 249 may be used in conjunction with the squeegee. That is, the flow coater is pivotally mounted on rod 251, having upstanding pin 253 therefrom engaging with link 255. Link 255 is connected to the extended piston rod 257 of a fluid cylinder 259 having its opposite end mounted to the support 261. Support 261 secures the pivot rod 258 for the squeegee support. This enables the flow coater blade 249 to be shifted into engagement with the squeegee support 247 for supporting a pool of ink therebetween if desired, the ends of this pool reservoir being enclosed by a pair of plates 263. A squeegee support 247 can include an elongated opening 247′ extending substantially the length thereof to allow excess ink ahead of the squeegee blade to flow up and through the opening into the reservoir between the flow coater and blade during the print stroke. On the return stroke, the flow coater is shifted away from the squeegee to be closely adjacent or in engagement with the stencil screen 238 to allow a new layer of ink to flow between the squeegee and flow coater down onto the screen for the next print stroke. As the printed stock is advanced past the stencilling station, and the print stroke is completed, the squeegee assembly and stencil screen frame are elevated in conventional fashion away from impression cylinder 64. The stock is advanced directly to pressure differential control unit 18.

Registration of the wide web can be achieved by mounting the web slitter upstream of the registration surface an amount just slightly less than the amount of web advancement with each intermittent feeding action as shown schematically at 230 in FIG. 6. This slitter can be in the form shown at 130 in FIG. 9 or the slightly different form shown in copending application Ser. No. 519,591, filed Oct. 31, 1974, entitled WEB SLIT REGISTRY by James A. Black and Harry Russell Farwell and incorporated by reference herein.

The web is stencilled at the stencilling station, and advanced to control unit 218 which has no divider panels, and then, if necessary, into dryer 20. At the dryer exit is another open top pressure control unit 217 to govern the feed of the web to the next operational station such as the second stencilling station 412. The details of this are shown in the above referred to copending application Ser. No. 515,639.

In FIG. 5 is schematically illustrated the apparatus in FIG. 4, but showing the straight through travel pattern of web stock, e.g. three side by side webs to be stencilled simultaneously in one station and then advanced directly without returning back to that station. These webs can thus be dried in the downstream pressure control unit and rewound as depicted, or advanced on to a dryer and/or another operational station.

Specifically these webs are fed, as from reels, through rolls 30, through web tension control unit 14, over guide roll 15, past pull-back unit 164, past slitter 230, and past register unit 112*a*. The slitter would include three slitting subassemblies like that at 130 in FIG. 9, or as shown in FIGS. 1 and 2 of copending application Ser. No. 519,591, identified above. The register unit 112*a* is like that at 112 in FIG. 9, except having three subassemblies 132, i.e. the third one being in place of slitter 130 in FIG. 9. The webs pass through the stencilling station between the imprint cylinder 64 and the multipart stencil screen frame 36 and multipart squeegee subassembly 44 in FIG. 15, and then through pressure differential control unit 18. At the stencilling station, all three webs are stencilled simultaneously with the same operational steps described relative to FIG. 1 previously.

If the drying action that occurs in unit 18 is adequate for the particular ink and stock and if only one stencil coat is to be applied, the stock can be rewound or subsequently operated upon as depicted in FIG. 5. However, if this drying function is not adequate, the stock can be passed through a tower dryer 20 as in FIG. 6 and then advanced to subsequent functions. If another printing operation is to be performed on the stock, it can then be passed through the next printing station 412, the apparatus in this station being controlled in slave fashion for example as explained relative to the conventional power takeoff in the structure in FIGS. 10 and 11. The specially printed web can then be passed through another pressure differential control and drying unit 418 and if necessary, through another tower dryer 420 before being advanced to subsequent operations.

As broadly mentioned previously, instead of the registration mechanism being upstream of the stencilling station, it can be placed downstream of the stencilling station as set forth in detail relative to the vacuum registration embodiment described relative to FIGS. 3–4 in the above referred to copending U.S. patent application Ser. No. 519,591.

As will be readily appreciated from the detailed description set forth above, and the variations explained, the apparatus is very versatile. The number of wraparound passes can be varied to that desired or necessary. The tower dryer can be used or not used as necessary. Moreover, although two successive stencilling stations and dryer arrangements are shown in succession in FIG. 3, the number can be varied. These and other obvious variations of the embodiments set forth as illustrative of the apparatus and method are intended to be within the scope of the invention as limited only by the scope of the appended claims and the reasonable equivalents thereto.

The embodiments of the invention in which an exclusive property or privilege is claimed are defined as follows:

1. A stencil press capable of successively stencilling repeat patterns on individual zones of a web at the same stencilling station comprising:

A. a stencilling station including (I) impression means for supporting web stock for printing, (II) squeegee means for stencilling on web stock, (III) means for supporting a stencil between said impression means and said squeegee means, and (IV) means for causing relative movement between said squeegee means and said stencil supporting means, B. web registry means for registration of said zones of the web for stencilling at said impression means; and C. web advancing and guide means for advancing and guiding successive ones of said zones of a web through a coiled path for repeat passage of individual ones of said successive zones of a web between said stencil supporting means and said impression means and in operative engagement with different ones of said registry means;

said web advancing and guide means including a pressure differential web control unit, said unit comprising a housing defining a chamber, having an opening, and configurated to receive a loop of web through said opening for curvalinear travel of the web into and out of said chamber; said housing including gaseous flow means for creating a gaseous pressure differential across the loop of web to retain the web in loop form in said chamber as successive web portions travel therethrough; said web control unit also comprising orienting means for orienting the ingoing and outgoing zones of the web loop at an acute angle to each other.

2. A stencil press capable of successively stencilling repeat patterns on individual zones of a web at the same stencilling station comprising:

A. a stencilling station including (i) impression means for supporting web stock for printing, (ii) squeegee means for stencilling on web stock, (iii) means for supporting a stencil between said impression means and said squeegee means, and (iv) means for causing relative movement between said squeegee means and said stencil supporting means, B. web registry means for registration of said zones of the web for stencilling st said impression means; and C. web advancing and guide means for advancing and guiding successive ones of said zones of a web through a coiled path for repeat passage of individual ones of said successive zones of a web between said stencil supporting means and said impression means and in operative engagement with different ones of said registry means;

said web advancing and guide means including a pressure differential web control unit, said unit comprising a housing defining a chamber, having an opening, and configurated to receive a loop of web through said opening for curvalinear travel of the web into and out of said chamber; said housing including gaseous flow means for creating a gaseous pressure differential across the loop of web to retain the web in loop form in said chamber as successive web portions travel therethrough; said web control unit being positioned to orient the web loop at an angle to said stencilling station for web alignment with said registry means.

* * * * *

UNITED STATES PATENT AND TRADEMARK OFFICE

CERTIFICATE OF CORRECTION

PATENT NO. : 3,973,489

DATED : August 10, 1976

INVENTOR(S) : James A. Black

It is certified that error appears in the above-identified patent and that said Letters Patent are hereby corrected as shown below:

Column 2, line 66:

"wrapped" should be ---wraparound---

Column 4, line 46:

"423" should be ---42a, 42b,---

Column 5, line 21:

"te" should be ---the---

Signed and Sealed this

Eighteenth Day of January 1977

[SEAL]

*Attest:*

RUTH C. MASON
*Attesting Officer*

C. MARSHALL DANN
*Commissioner of Patents and Trademarks*